US007572193B2

(12) United States Patent
Yokota

(10) Patent No.: US 7,572,193 B2
(45) Date of Patent: Aug. 11, 2009

(54) GOLF CLUB HEAD

(75) Inventor: Masatoshi Yokota, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 182 days.

(21) Appl. No.: 11/723,341

(22) Filed: Mar. 19, 2007

(65) Prior Publication Data

US 2007/0238551 A1 Oct. 11, 2007

(51) Int. Cl.
*A63B 53/04* (2006.01)

(52) U.S. Cl. ..... 473/328; 473/338; 473/345; 473/346; 473/349

(58) Field of Classification Search ..... 473/324–350
See application file for complete search history.

(56) References Cited

U.S. PATENT DOCUMENTS 5,316,305 A * 5/1994 McCabe ..... 473/332
6,773,360 B2 * 8/2004 Willett et al. ..... 473/334
7,101,291 B2 9/2006 Yamamoto et al.
7,273,423 B2 * 9/2007 Imamoto ..... 473/332
7,407,447 B2 * 8/2008 Beach et al. ..... 473/324
2006/0122004 A1 * 6/2006 Chen et al. ..... 473/335
2008/0261715 A1 * 10/2008 Carter ..... 473/291

FOREIGN PATENT DOCUMENTS

JP 11-312864 * 5/2001

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises: a face portion having a front face forming a club face and a rear face facing a hollow; a sole portion extending backward from the face portion and having an outer surface forming an undersurface of the head and an inner surface facing the hollow, the sole portion provided with a tubular part whose hole forms a socket; and a weight member secured in the socket. The tubular part protrudes from the inner surface of the sole portion into the hollow. The sole portion is provided on the outer surface with at least one stiffening groove so that said at least one stiffening groove forms at least one stiffening rib on the, inner surface of the sole portion, and the stiffening groove is partially included in a vicinity zone which is defined as extending 10 mm from the socket.

10 Claims, 7 Drawing Sheets

GOLF CLUB HEAD

BACKGROUND OF THE INVENTION

The present invention relates to a golf club head, more particularly to a reinforcing structure for the sole portion provided with a separate weight member.

In recent years, wood-type hollow club heads for drivers and the like are increased in the volume, while preventing the weight from increasing. Accordingly, there is a tendency that the wall thickness of the sole portion becomes decreased like the other portions of the head.

On the other hand, in the golfers especially average golfers, there are great demands for golf club heads with a low and deep center of gravity to produce a high launch angel with low spin for longer and straight drives.

In the U.S. Pat. No. 7,101,291, a wood-type hollow golf club head is disclosed, wherein a tubular socket is integrally provided on the inside of the sole portion, and a weight member is secured in the socket. In such a structure, if the mass of the weight member is increased in order to lower and deepen the center of gravity of the head, as the tubular socket protrudes relatively high into the hollow of the head and the socket is filled with a heavy metal, the socket is vibrated when striking a ball, especially when duffing a ball, and a large stress acts on the vicinity of the socket. Thus, such a vicinity zone becomes a weak point, and in the worst case, a crack is caused in the vicinity zone. As a result, the adjustable range of the position of the center of gravity of the head is limited and it becomes difficult to set the center of gravity at the desired position because it is necessary to limit the mass of the weight member not to cause a large stress.

SUMMARY OF THE INVENTION

It is therefore, an object of the present invention to provide a golf club head, in which the sole portion is reinforced in the vicinity of the socket so as to increase the upper limit of the mass of the weight member without causing the weak point or damage, and thereby the position of the center of gravity of the head can be adjusted in a wide range as desired and thus more lowing and deepening are possible.

According to the present invention, a golf club head comprises: a face portion having a front face forming a club face and a rear face facing a hollow; a sole portion extending backward from the face portion and having an inner surface facing the hollow and an outer surface forming the undersurface of the head, the sole portion provided with a tubular part whose hole forms a socket; and a weight member secured in the socket, wherein the tubular part protrudes from the inner surface of the sole portion into the hollow, and the sole portion is provided on the outer surface with at least one stiffening groove so as to form at least one stiffening rib on the inner surface of the sole portion, and the stiffening groove is partially included in a vicinity zone which is defined as extending 10 mm from the socket.

DEFINITIONS

The standard state of a golf club head is defined such that the head is placed on a horizontal plane HP so that the center line CL of the club shaft or shaft inserting hole 7*a* is inclined at the lie angle while keeping the center line CL on a vertical plane VP, and the club face forms its loft angle with respect to the vertical plane VP.

The back-and-forth direction of the head is a direction Y parallel with the horizontal plane HP and parallel with a straight line N drawn normally to the club face passing the center G of gravity of the head. Incidentally, the point of intersection between the club face and the straight line N is the sweet spot SS.

DESCRIPTION OF THE PREFERRED EMBODIMENTS

Figure 1:
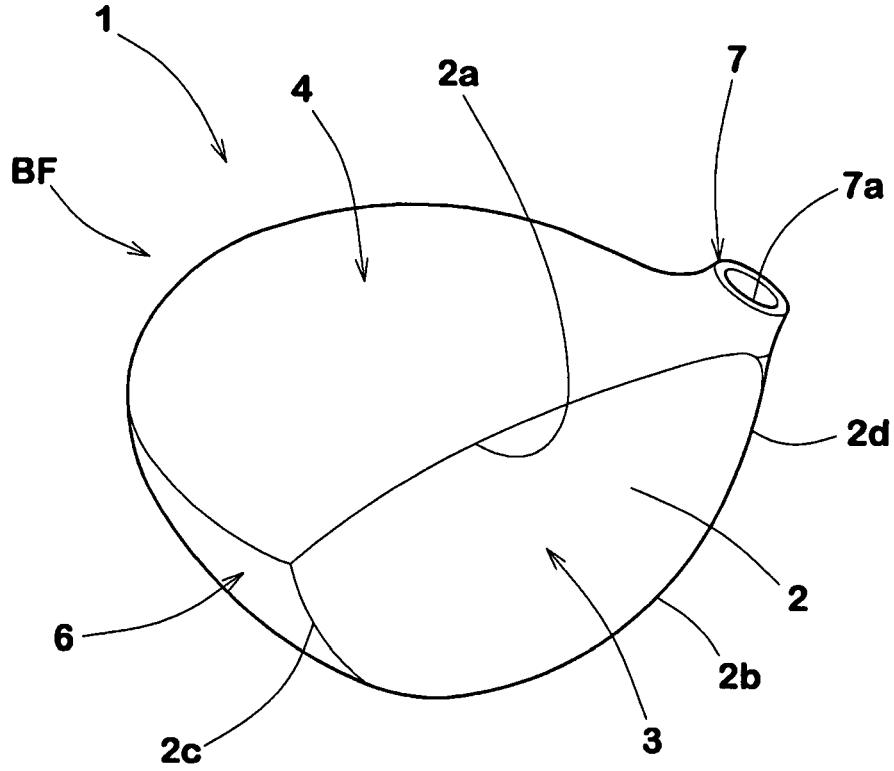
FIG. 1 is a perspective view showing a general overall shape of a wood-type hollow golf club head employed in the following embodiments of the present invention.

Embodiments of the present invention will now be described in detail in conjunction with the accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In the case of a wood-type club head for a driver (#1), it is preferable that the head volume is set in a range of not less than 350 cc, more preferably not less than 380 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 460 cc.

The mass of the club head 1 is preferably set in a range of not less than 180 grams in view of the swing balance and rebound performance, but not more than 210 grams in view of the directionality and traveling distance of the ball.

The club head 1 is made up of a main body 1A and a weight member 9. Here, the main body 1A includes the above-mentioned face portion 3, crown portion 4, side portion 6 and hosel portion 7 and further a sole main part 5*a* forming an almost entire part of the sole portion 5 is also included.

The main body 1A is made of one or more kinds of metal materials, e.g. stainless steels, maraging steels, pure titanium, titanium alloys, aluminum alloys, magnesium alloys, amorphous alloys and the like. The main body 1A is formed by assembling a plurality of metal parts each prepared by a suitable process, e.g. forging, casting, press molding and the like. Also it is possible to use a nonmetallic material such as a fiber reinforced resin to form a part of the main body 1A.

The apparent specific gravity of the main body 1A obtained by the total mass and physical volume of all the materials of the main body 1A in the case of a plurality of materials are used OR the specific gravity of the main body 1A in the case of a single material is used, is preferably not more than 7.0, more preferably not more than 6.0, still more preferably not more than 5.0, but preferably not less than 3.0, more preferably not less than 4.0. If such specific gravity is too large, it becomes necessary to decrease the head volume against the requirement in order to maintain the club head weight. If too small, it becomes difficult to provide minimal strength for the club head.

The weight member 9 is made of a metal material having a specific gravity which is larger than a specific gravity of the above-mentioned sole main part 5*a* and also larger than the specific gravity of the main body 1A in the above sense. The specific gravity of the weight member 9 is preferably not less than 8.0, more preferably not less than 10.0, still more preferably not less than 15.0, but not more than 25.0. For examples, copper, copper alloys, tungsten, tungsten alloys, brass and the like can be used alone or in combination.

The weight member 9 is secured in a socket 8 which is provided in the sole portion 5 of the main body 1A so that the socket 8 opens at the outer surface 5S of the sole portion 5.

Figure 4:
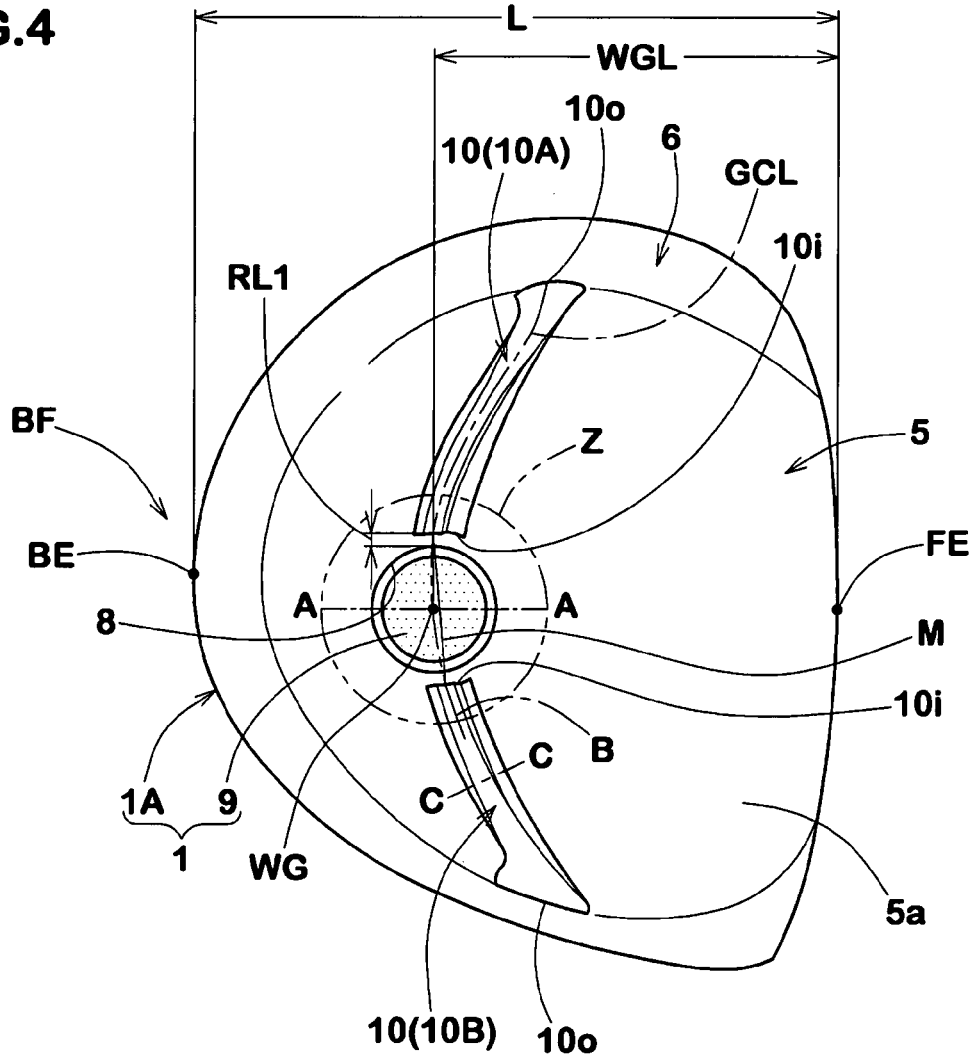
FIG. 4 is a bottom view thereof.

As to the position of the socket 8, in order to deepen the center G of gravity of the head, it is desirable that the ratio (WG/L) of the length WG between the front end FE and the center axis of the socket(namely, between the front end FE and the center WD of gravity of the weight member in the socket 8) to the length L between the front end FE and rear end BE of the club head, both measured in the back-and-forth direction of the head in parallel with the horizontal direction in the standard state of the head as shown in FIG. 4, is not less than 0.5, preferably not less than 0.6.

The weight member 9 inserted in the socket 8 can be fixed to the main body 1A by means of press fitting, caulking, adhesive bonding, welding and the like. But, in this example, a screw fixation is utilized as explained bellow.

The socket 8 is formed by a tubular part protruding from the inner surface of the sole portion 5 into the hollow (i). The socket 8 can be a blind hole, but in this example, the socket 8 is a circular through hole penetrating the sole portion 5. The center axis of the socket 8 is substantially perpendicular to the outer surface 5S.

The inside diameter of the socket 8 is gradually decreased from the outer end at the outer surface 5S to the inner end thereof.

In this example, the socket 8 comprises:

a tapered part 8*a* extending from the outer surface 5S of the sole portion 5 toward the inside of the head while gradually decreasing its inside diameter;

a constant diameter part 8*b* extending inwardly from the tapered part 8*a* while maintaining its inside diameter which is substantially equal to the minimum inside diameter of the tapered part 8*a*; and a threaded part 8*c* extending inwardly from the constant diameter part 8*b* and provided with a thread groove having a diameter at the thread crest which is less than the inside diameter of the constant diameter part 8*b*.

Preferably, the difference (r) between the maximum radius and minimum radius of the tapered part 8*a* is not less than 1.0 mm, but not more than 3.0 mm, more preferably not more than 2.0 mm, still more preferably not more than 1.5 mm. As a result, the rigidity around the socket 8 can be increased to control vibrations of the sole portion 5 and weight member 9 at impact.

Corresponding to the socket 8, the weight member 9 is provided with: a threaded part 9*a* engaging with the threaded part 8*c* of the socket 8; and an increased-diameter part 9*b* at the outer end of the threaded part 9*a* in order to lower the center of gravity of the weight member 9.

The increased-diameter part 9*b* has an outer diameter which is more than the diameter at the thread crest of the threaded part 9*a*, and less than the minimum inside diameter of the tapered part 8*a* of the socket 8.

The weight member 9 can be inserted from the outside of the sole portion 5 and screwed together. Incidentally, the increased-diameter part 9*b* is provided at the outer end with a groove or dent (not shown) to engage with a screw wrench or the like.

Figure 5:
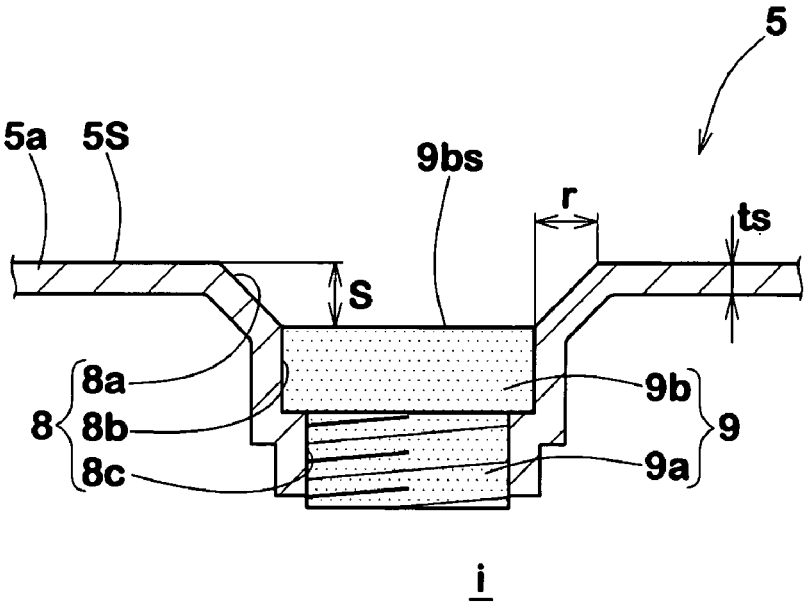
FIG. 5 is an enlarged cross sectional view taken along a line A-A in FIG. 4.

As shown in FIG. 5, when the weight member 9 is secured in the socket 8, the outer end 9*bs* of the weight member 9 is positioned within the socket 8 so as to prevent the weight member 9 from contacting with the ground. If the depth S of the outer end 9*bs* from the outer surface 5S is too small, as the weight member 9 contacts with the ground, there is a possibility that the weight member 9 is loosened during use. If too large, there is a possibility that dirt and turf are packed in the hole, and the center of gravity becomes high, and as a result, the vibrations of the weight member and tubular socket part increase. Therefore, the depth s is preferably not less than 1.0 mm, but not more than 3.0 mm.

According to the present invention, the main body 1A is provided in the outer surface 5S of the sole portion with at least one groove 10 (hereinafter the "stiffening groove 10") for stiffening the sole portion 5 especially at least the vicinity of the socket 8.

The "stiffening groove 10" opened at the outer surface 5S and extends towards the periphery of the sole portion 5 from a vicinity zone Z to the outside thereof. The vicinity zone Z is defined as extending 10 mm from the socket 8. As the socket 8 in this example is a circular hole, the vicinity zone Z is defined by a circular zone whose radius is 10 mm larger than the radius of the socket at the outer surface 5S of the sole portion 5.

It is necessary that, by forming the stiffening groove 10 on the outer surface 5S, a rib protruding from the inner surface of the sole portion 5 towards the hollow (i) is formed.

Figure 15:
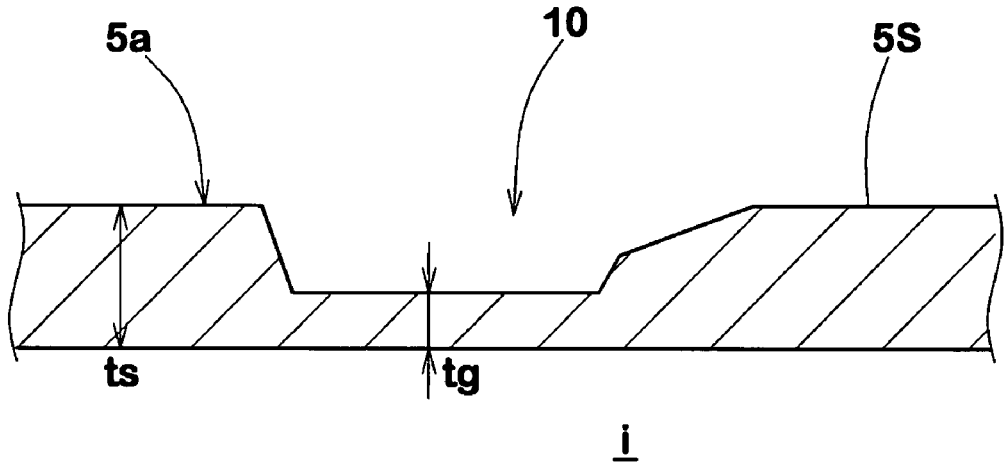
FIG. 15 is a cross sectional view (similar to FIG. 11) for explaining a groove not encompassed in the present invention.

Therefore, the thickness tg of the wall which forms the groove 10 is substantially same as or more than the thickness ts of the sole main part 5*a*. Accordingly, an example shown in FIG. 15 wherein ts>tg is not included in the scope of the present invention.

Preferably, the thickness tg is not less than 0.5 mm, more preferably not less than 0.8 mm, still more preferably not less than 1.0 mm, but not more than 2.0 mm for a proper strength. In the following embodiments, the thickness tg is equal to the thickness ts.

If the distance between the socket 8 and the groove 10 is more than 10 mm, the vicinity zone Z can not be reinforced by the resultant rib.

Figure 7:
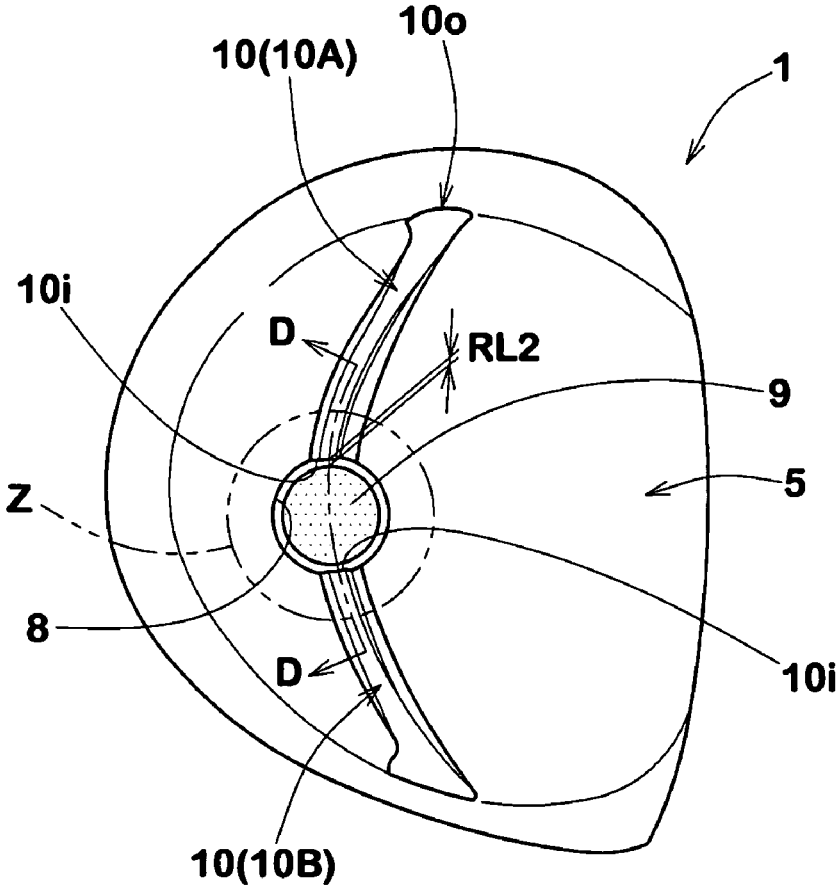
FIG. 7 is a bottom view of another embodiment of the present invention.
Figure 9:
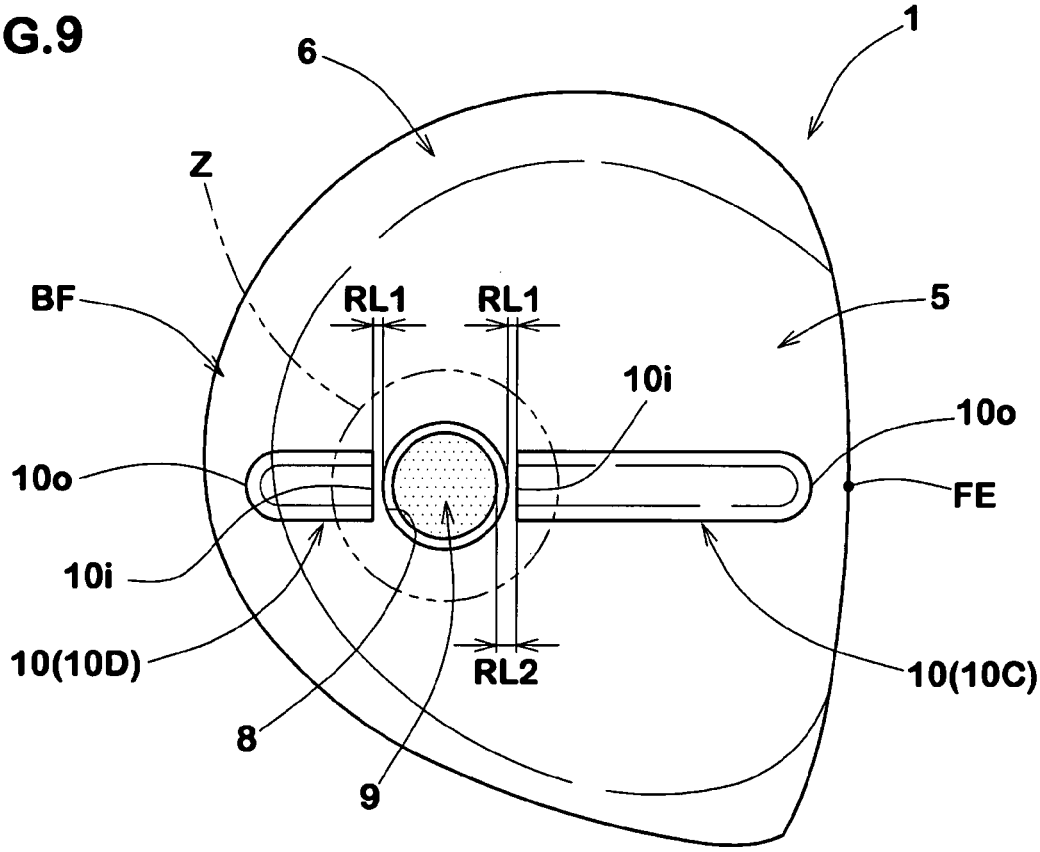
FIG. 9 is a bottom view of still another embodiment of the present invention.

Therefore, the stiffening groove 10 can start from a position at a small distance from the socket 8 within the vicinity zone Z as shown in FIG. 4 and FIG. 9, OR a position at the socket 8 as shown in FIG. 7.

Figure 10:
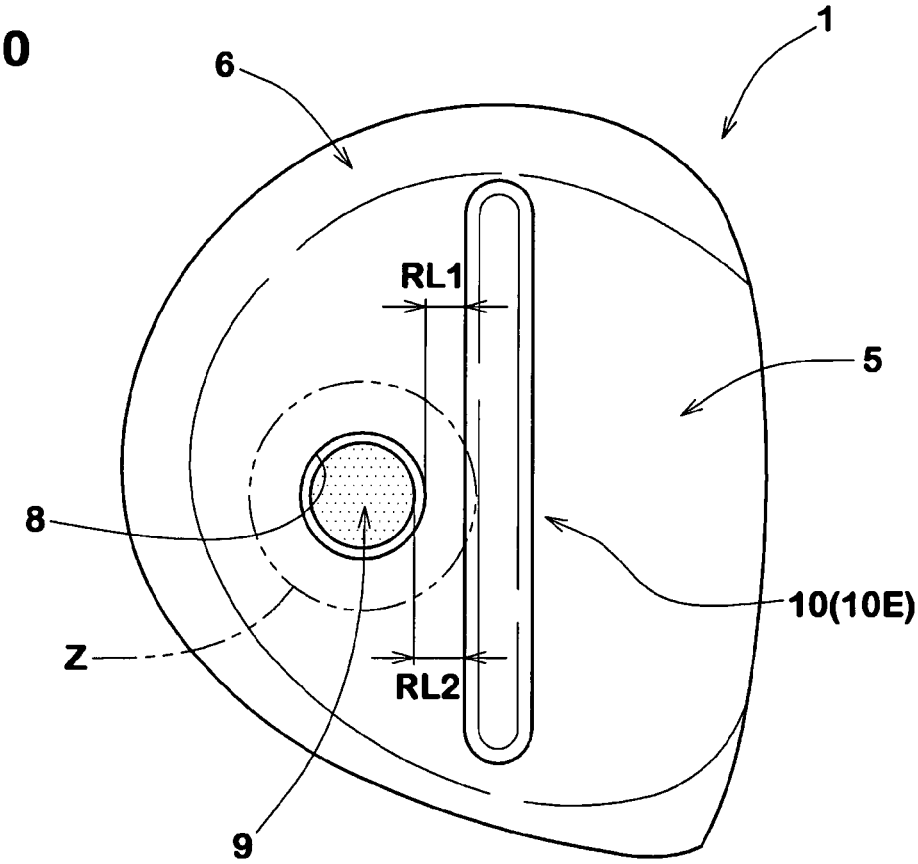
FIG. 10 is a bottom view of a further embodiment of the present invention.

Further, the stiffening groove 10 can pass by the socket 8 as shown in FIG. 10, instead of starting from the vicinity zone z.

In either case, the stiffening groove 10 can extends in a lateral direction as shown in FIG. 4, FIG. 7 and FIG. 10, OR in a back-and-forth direction as shown in FIG. 9.

In any case, it is necessary that the stiffening groove 10 is partially included in the vicinity zone Z to effectively reinforce the vicinity zone Z.

Figure 3:
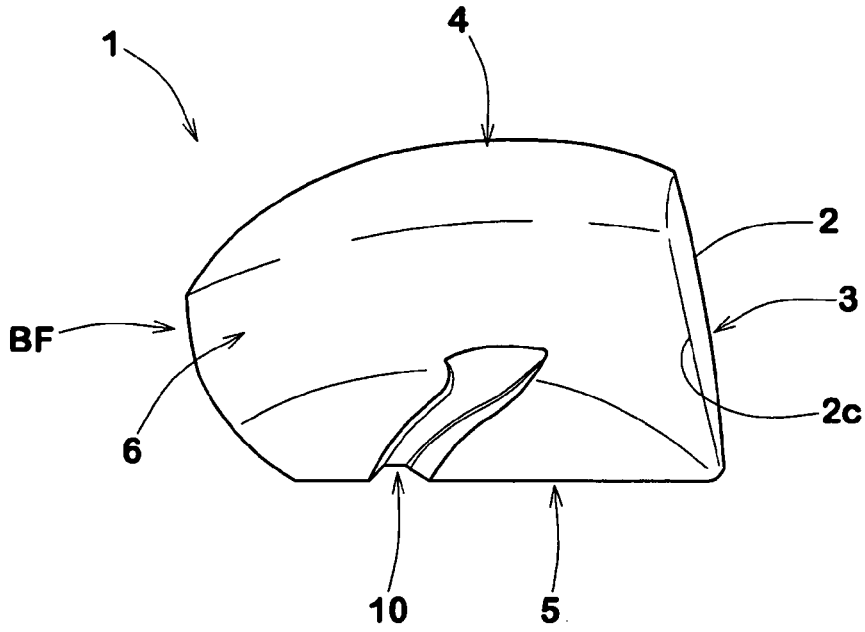
FIG. 3 is a left side view of an embodiment of the present invention.

In the embodiment shown in FIG. 4 and FIG. 3, two grooves 10 are provided, which are a groove 10A disposed on the toe-side of the socket 8 and a groove 10B disposed on the heel-side of the socket 8. The groove 10A extends towards the toe from its first end 10*i* within the vicinity zone Z to its second end 10*o* at the periphery edge of the sole portion 5, while curving convexly towards the face. The groove 10B extends towards the heel from its first end 10*i* within the vicinity zone Z to its second end 10*o* at the periphery edge of the sole portion 5, while curving convexly towards the face.

FIG. 7 shows a modification of the embodiment shown in FIG. 4, wherein each groove 10A, 10B is connected to the socket 8. In other words, each groove starts from the socket 8 as shown in FIG. 8 which is a cross sectional view taken along a line D-D in FIG. 7.

Figure 6:
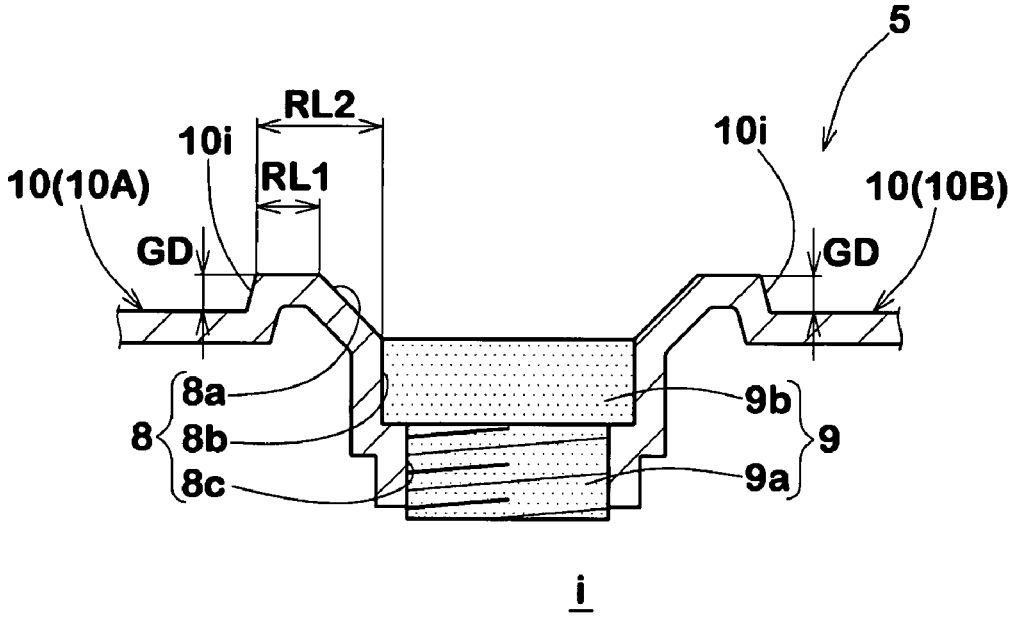
FIG. 6 is an enlarged cross sectional view taken along a line B-B in FIG. 4.
Figure 8:
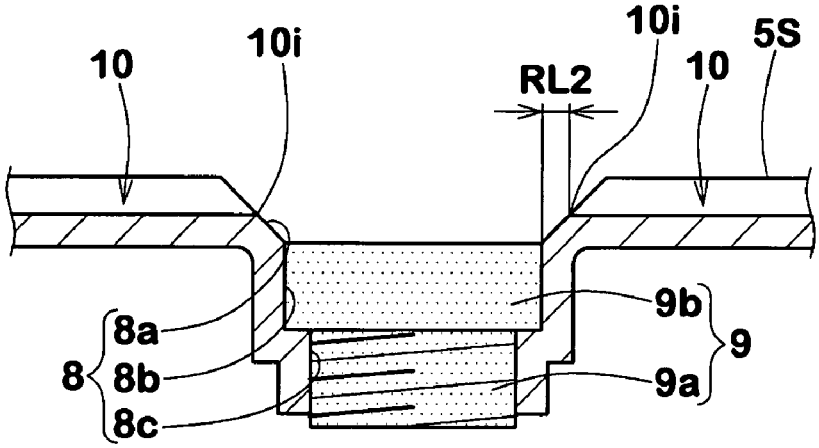
FIG. 8 is an enlarged cross sectional view taken along a line D-D in FIG. 7.

As a further embodiment, such a modification is also possible that one of the two grooves 10A and 10B is connected to the socket 8 as shown in a left or right half of FIG. 8, but the other is not connected as shown in a left or right half of FIG. 6.

FIG. 9 shows another embodiment of the present invention, wherein two grooves 10 (10C and 10D) are arranged in line in substantially parallel with the back-and-forth direction of the head. The groove 10C is disposed on the face-side of the socket 8, and extends in the back-and-forth direction from its first end 10*i* within the vicinity zone Z to its second end 10*o* near the front edge of the sole portion 5. The groove 10D is disposed on the back-side of the socket 8, and extends in the back-and-forth direction from its first end within the vicinity zone Z to its second end in the side portion 6.

FIG. 10 shows still another embodiment of the present invention. In this embodiment, unlike the former embodiments, the ends of the groove 10 (10E) are not located in the vicinity zone Z, but the groove 10E passes by the socket 8 so that a middle part of the groove 10E is located in the vicinity zone Z. The groove 10E extends in a heel-and-toe direction perpendicular to the back-and-forth direction.

In the bottom view (FIGS. 4, 7, 9, 10), the grooves 10 are arranged almost line-symmetrically about a line passing through the center WG of gravity of the weight member 9 in parallel with the back-and-forth direction of the head.

Aside from the FIG. 10 example, the groove 10 can be protruded from the sole portion 5 into the side portion 6, namely, the second end 10*o* can be positioned in the side portion 6.

In any case, the minimum distance RL1 between the socket 8 and the groove 10 (10A, 10B, 10C, 10D, 10E) is still necessary to be not more than 10 mm, preferably not more than 7.0 mm, more preferably not less than 5.0 mm, most preferably not more than 3.0 mm. In the case that the groove 10 is not connected to the socket 8, in order to maintain a necessary groove wall thickness, the minimum distance RL1 is preferably not less than 1.0 mm, more preferably not less than 1.5 mm, still more preferably not less than 2.0 mm.

For the similar reasons to RL1, the minimum distance RL2 between the weight member 9 and the groove 10 is preferably set in a range of not less than 1.0 mm, more preferably not less than 1.5 mm, still more preferably not less than 2.5 mm, most preferably not less than 3.5 mm, but not more than 10.0 mm, more preferably not more than 7.0 mm, still more preferably not more than 5.0 mm.

The length of the groove 10 measured along its widthwise center line is preferably not less than 15 mm, more preferably not less than 20 mm, still more preferably not less than 25 mm. But, if the groove 10 is too long, the weight is increased although the reinforcing effect reaches the ceiling. Therefore, the length is preferably not more than 70 mm, more preferably not more than 50 mm, still more preferably not more than 40 mm.

The open top width GW of the groove 10 is preferably not less than 1 mm, more preferably not less than 2 mm, but not more than 10 mm, more preferably not more than 7 mm, when measured perpendicularly to the widthwise center line of the groove.

In the above embodiments, excepting the end portions of the groove 10, the open top width GW is substantially constant along the groove length. But, the groove width is increased at the second end 10*o* in the case of FIG. 4 and FIG. 7. In the case of FIG. 9 and FIG. 10, the groove width is decreased at the second end 10*o*.

The depth GD of the groove 10 is preferably not less than 0.5 mm, but not more than 2.0 mm.

The depth GD can be gradually decreased from the first end 10*i* to the second end 10*o* as in the embodiments shown in FIG. 4 and FIG. 7. But, it is also possible that the depth GD is constant along the almost entire length excepting both end portions as in the embodiments shown in FIG. 9 and FIG. 10.

Figure 11:
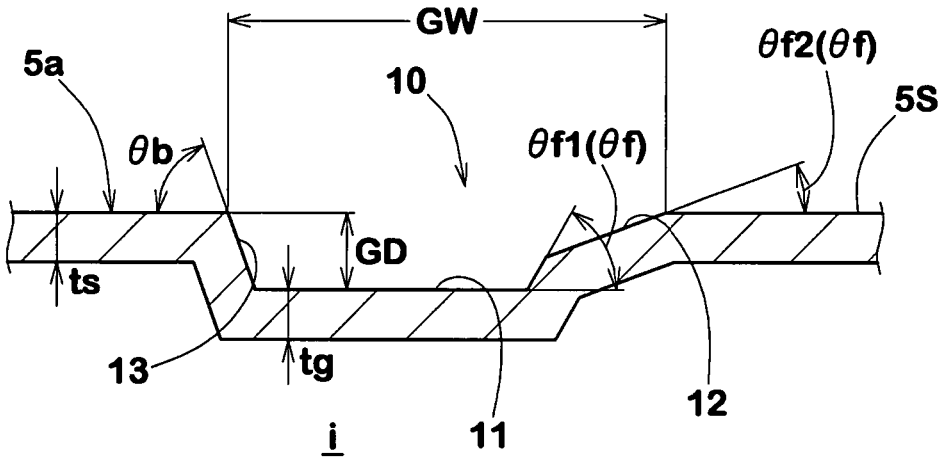
FIG. 11 is a cross sectional view taken along a line C-C in FIG. 4 showing an example of the stiffening groove.

FIG. 11 shows an example of the cross sectional shape of the groove 10 which is employed in the above embodiments.

In this example, the groove 10 has a substantially flat, wide bottom wall 11, and a first side wall 12 and a second side wall 13 which extend from the face-side edge and back-side edge of the bottom wall 11, respectively.

The side walls 12 and 13 are inclined such that the width between the side walls 12 and 13 increases from the bottom to the top of the groove. The inclination angle θf of the side wall 12 and the inclination angle θb of the side wall 13 are preferably not less than 10 degrees, more preferably not less than 15 degrees, still more preferably not less than 30 degrees, but less than 90 degrees, more preferably not more than 80 degrees with respect to the horizontal plane HP under the standard state of the head. If less than 10 degrees, it becomes difficult to reinforce the vicinity zone Z.

The angle θf can be the same as the angle θb. In this example, however, the side wall 12 is made up of an inner part having an angle θf1 and an outer part having a different angle θf2. The angle θf2 is large than the angle θf1, but substantially same as the angle θb of the side wall 13. Therefore, the stress acting on the side wall 12 at impact can be effectively dispersed, and damage occurring near the front edge of the groove can be prevented.

Figure 12:
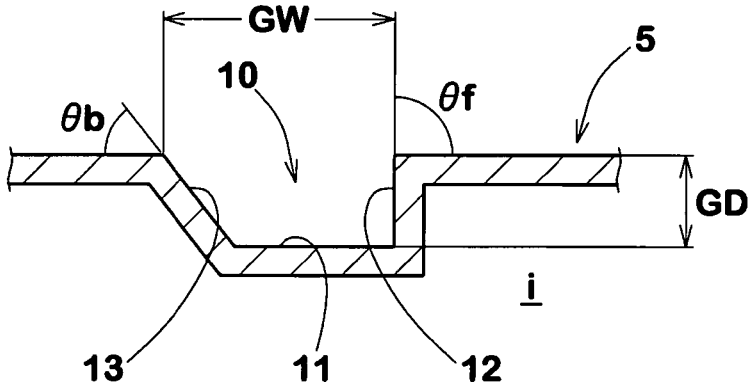
FIGS. 12, 13 and 14 are cross sectional views (similar to FIG. 11) each showing another example of the stiffening groove.
Figure 13:
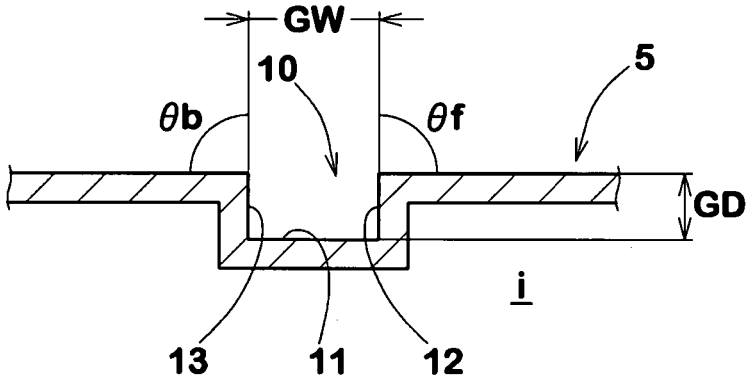
Figure 14:
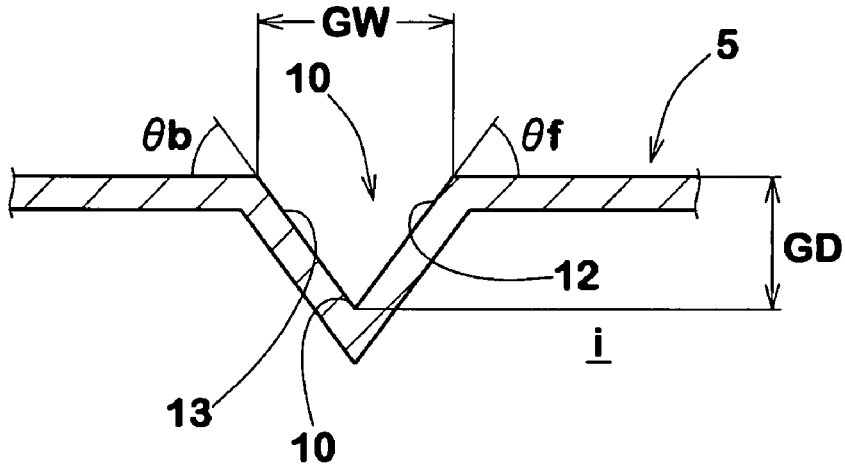

FIG. 12, FIG. 13 and FIG. 14 each shows another example of the cross sectional shape which can be employed in the above embodiments instead of the example shown in FIG. 11.

In FIG. 12, the groove 10 has the substantially flat bottom wall 11, first side wall 12 and second side wall 13. The angle θb of the side wall 13 is smaller than the angle θf of the side wall 12. The difference θf-θb is preferably set in a range of not less than 10 degrees, more preferably not less than 20 degrees, but not more than 60 degrees, more preferably not more than 40 degrees, still more preferably not more than 30 degrees. For example, the angle θf is substantially 90 degrees and the angle θb is about 45 degrees +/−15 degrees.

In FIG. 13, the groove 10 has the substantially flat bottom wall 11, first side wall 12 and second side wall 13. The angles θf and θb of the side walls 12 and 13 are substantially 90 degrees. Accordingly, the groove 10 has a substantially rectangular cross section.

In FIG. 14, the flat bottom wall 11 was omitted. Therefore, the groove 10 has the first side wall 12 and second side wall 13 only. The side walls 12 and 13 have inclination angles θf and θb less than 90 degrees which are substantially identical in this illustrated example. Accordingly, the groove 10 has a triangular cross section.

Comparison Tests

Figure 2:
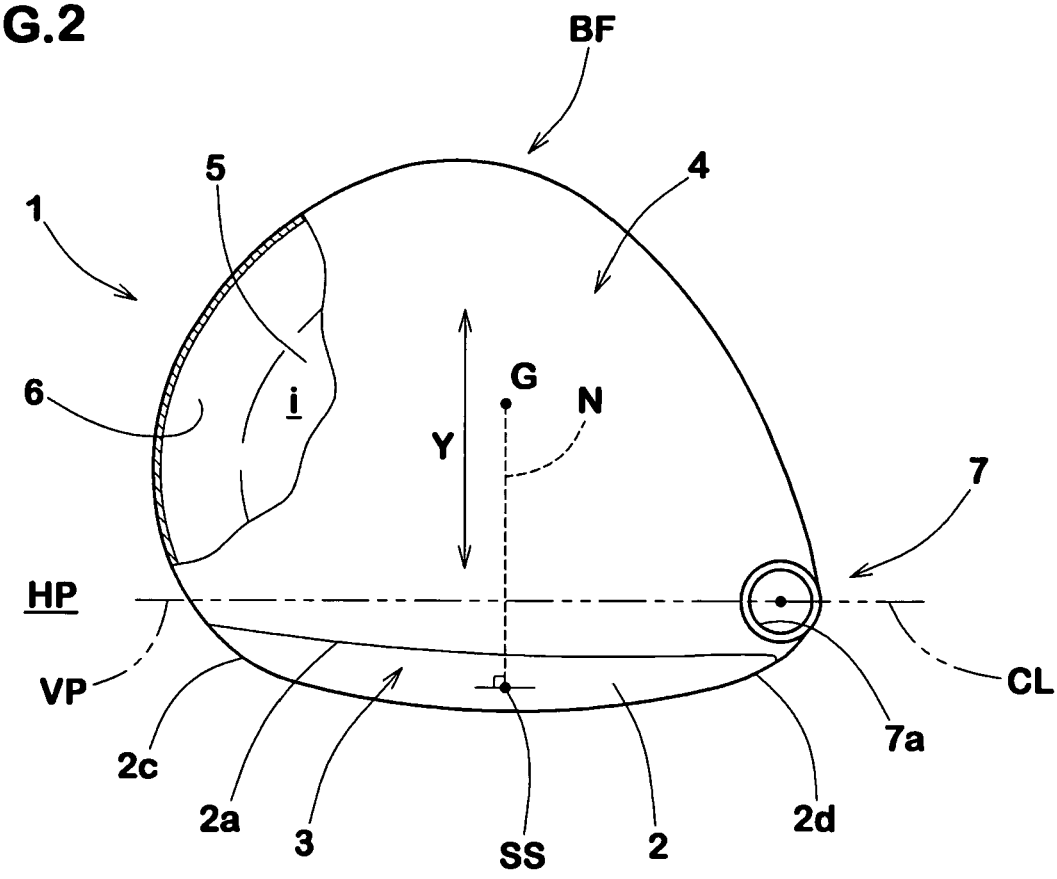
FIG. 2 is a top view thereof.

Wood-type golf club heads as shown in FIGS. 1 and 2 having a volume of 460 cc were prepared and tested for the resistance to loosening of the weight member and the resistance to crack of the vicinity of the socket.

All the heads had the same structure except for the stiffening grooves, and each head excluding the weight member (i.e. the main body) was formed from a titanium alloy Ti-6Al-4V by lost-wax precision casting. The thread of the socket was formed after casting. The thickness ts of the sole main part was 1.1 mm.

The weight member was formed from a W—N sintered alloy having a specific gravity of 14.5 and a mass of 8 grams. As shown in FIG. 5, the weight member had a threaded part 9*a* (Diameter at the crest: 5.0 mm) and an increased-diameter part 9*b* (Outer diameter: 12 mm).

The weight member was screwed into the socket after an adhesive agent was applied to the thread groove. The adhesive agent used was Epoxy adhesive "DP460" manufactured by Sumitomo 3M Limited.

Resistance to loosening test:

The club heads were attached to identical FRP shafts to make 45-inch wood clubs. Each club was mounted on a swing robot and hit golf balls ("XXIO" manufactured by SRI sports Ltd.) up to 10000 times at a head speed of 40 meter/second, and every 100 hits the weight member was checked whether the weight member was still screwed up or loosed. If loosed, the number of hits was recorded. The results are indicated in Table 1, wherein "ok" indicates that the weight member was not loosed even after 10000 hits.

Crack Resistance Test:

Targeting the club heads marked as "ok" in the above Resistance to loosening test, a further test was conducted using newly prepared club heads. The test was conducted similarly to the above, but the head speed was increased to a very high speed of 50 meter/second. And every 100 hits up to 5000 hits, the vicinity of the socket was checked for crack by the naked eye from the outside of the head. If a crack was found, the number of hits was recorded. The results are indicated in Table 1, wherein "ok" indicates that there was no crack even after 5000 hits.

The present invention is suitably applied to a wood-type hollow head of a shell structure having a thin wall. But, it is also possible to apply the present invention to other types of golf club heads such as iron-type and utility-type as far as the head is provided in the thin sole portion with a socket for a separate weight member.

TABLE 1

| | Club head | | | | | | | | | |
|---|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 | Ref. |
| | Structure | | | | | | | | | |
| | FIG. 4 | FIG. 4 | FIG. 4 | FIG. 4 | FIG. 4 | *1 | FIG. 7 | FIG. 9 | FIG. 10 | *2 |
| WGL/L | 0.67 | 0.67 | 0.67 | 0.67 | 0.67 | 0.67 | 0.67 | 0.67 | 0.67 | 0.67 |
| Depth S (mm) | 1.5 | 1.5 | 1.5 | 1.5 | 1.5 | 1.5 | 1.5 | 1.5 | 1.5 | 1.5 |
| Difference r (mm) | 1.5 | 1.5 | 1.5 | 1.5 | 1.5 | 1.5 | 1.5 | 1.5 | 1.5 | 1.5 |
| Min. distance RL1 (mm) | 1.0 | 2.0 | 5.0 | 7.0 | 10.0 | 2.0 | 0 | 2.0 | 7.0 | — |
| Min. distance RL2 (mm) | 2.5 | 3.5 | 6.5 | 8.5 | 11.5 | 2.5 | 1.5 | 3.5 | 8.5 | — |
| Groove length *3 (mm) | 30 | 30 | 30 | 28 | 25 | 32 | 32 | 30 | 60 | — |
| Groove length *4 (mm) | 26 | 26 | 26 | 24 | 20 | — | 28 | 15 | — | — |
| Test results | | | | | | | | | | |
| Resistance to loosening | ok | ok | ok | 8700 | 5100 | 9200 | ok | 9300 | 5200 | 3900 |
| Crack resistance | 4300 *5 | ok | ok | — | — | — | 1900 *6 | — | — | — |

*1 Similar to the FIG. 4 structure, but one of two grooves on the heel-side was eliminated.
*2 Similar to the FIG. 4 structure, but the two grooves were eliminated.
*3 of the groove on the toe-side/clubface-side
*4 of the groove on the heel-side/back-face-side
*5 Crack was found in the part between the socket and groove.
*6 Crack was found at the junction of the socket and groove.

The invention claimed is:

1. A golf club head comprising:

a face portion having a front face forming a club face and a rear face facing a hollow;

a sole portion extending backward from the face portion and having an inner surface facing the hollow and an outer surface forming an undersurface of the head, the sole portion provided with a tubular part having a hole that forms a socket; and a weight member secured in the socket, wherein the tubular part protrudes from the inner surface of the sole portion into the hollow, the sole portion is provided on the outer surface with at least one stiffening groove so that said at least one stiffening groove forms at least one stiffening rib on the inner surface of the sole portion, and the stiffening groove is partially included in a vicinity zone which is defined as extending 10 mm from the socket, wherein said at least one stiffening groove is a toe-side groove and a heel-side groove each not connected to the socket, the heel-side groove extends towards a heel side from a starting point within the vicinity zone while curving towards a club face side, and the toe-side groove extends towards a toe side from a starting point within the vicinity zone while curving towards a club face side.

2. A golf club head comprising:

a face portion having a front face forming a club face and a rear face facing a hollow;

a sole portion extending backward from the face portion and having an inner surface facing the hollow and an outer surface forming an undersurface of the head, the sole portion provided with a tubular part having a hole that forms a socket; and a weight member secured in the socket, wherein the tubular part protrudes from the inner surface of the sole portion into the hollow, the sole portion is provided on the outer surface with at least one stiffening groove so that said at least one stiffening groove forms at least one stiffening rib on the inner surface of the sole portion, and the stiffening groove is partially included in a vicinity zone which is defined as extending 10 mm from the socket, wherein said at least one stiffening groove is a toe-side groove and a heel-side groove each connected to the socket, the heel-side groove extends towards a heel side from the socket while curving towards a club face side, and the toe-side groove extends towards a toe side from the socket while curving towards a club face side.

3. A golf club head comprising:

a face portion having a front face forming a club face and a rear face facing a hollow;

a sole portion extending backward from the face portion and having an inner surface facing the hollow and an outer surface forming an undersurface of the head, the sole portion provided with a tubular part having a hole that forms a socket; and a weight member secured in the socket, wherein the tubular part protrudes from the inner surface of the sole portion into the hollow, the sole portion is provided on the outer surface with at least one stiffening groove so that said at least one stiffening groove forms at least one stiffening rib on the inner surface of the sole portion, and the stiffening groove is partially included in a vicinity zone which is defined as extending 10 mm from the socket, wherein said at least one stiffening groove is a groove extending straight towards the club face from a starting point within the vicinity zone, and a groove extending straight towards the back side of the head from a starting point within the vicinity zone.

4. A golf club head comprising:

a face portion having a front face forming a club face and a rear face facing a hollow;

a sole portion extending backward from the face portion and having an inner surface facing the hollow and an outer surface forming an undersurface of the head, the sole portion provided with a tubular part having a hole that forms a socket; and a weight member secured in the socket, wherein the tubular part protrudes from the inner surface of the sole portion into the hollow, the sole portion is provided on the outer surface with at least one stiffening groove so that said at least one stiffening groove forms at least one stiffening rib on the inner surface of the sole portion, and the stiffening groove is partially included in a vicinity zone which is defined as extending 10 mm from the socket, wherein said at least one stiffening groove is a single groove extending straight in the heel-and-toe direction of the head, and the minimum distance between the stiffening groove and the socket is in a range of from 1.0 to 10.0 mm and occurs in the middle of the length of the stiffening groove.

5. The golf club head according to claim 1, 2, 3 or 4, wherein the socket provided in the sole portion is single.

6. The golf club head according to claim 1, 2, 3 or 4, wherein the socket provided in the sole portion is single, and formed at a position in a range of not less than 0.5 times the length from the front end to the rear end of the head in the bottom plan view of the head from the front end.

7. The golf club head according to claim 1, 2, 3 or 4, wherein said at least one stiffening groove has a depth of from 0.5 to 2.0 mm.

8. The golf club head according to claim 1, 2, 3 or 4, wherein the thickness of the wall forming said at least one stiffening groove is not more than 2.0 mm, and not less than the thickness of a main part of the sole portion.

9. The golf club head according to claim 1, 2, 3 or 4, wherein each said stiffening groove has a length of not less than 15 mm and an opening width of from 1 to 10 mm.

10. The golf club head according to claim 1, 2, 3 or 4, wherein the socket comprises: a threaded inner part having a first inside diameter at the top of the thread; and an outer part having a second inside diameter larger than the first inside diameter, and the weight member comprises: a threaded part engaging with the threaded part of the socket; and an increased-diameter part placed within the outer part of the socket.

* * * * *